United States Patent [19]

Kochey

[11] 4,213,402

[45] Jul. 22, 1980

[54] COOLING MEANS FOR A WATER-FILLED ASH HOPPER

[75] Inventor: Edward L. Kochey, Colebrook, Conn.

[73] Assignee: Combustion Engineering, Inc., Windsor, Conn.

[21] Appl. No.: 967,744

[22] Filed: Dec. 8, 1978

[51] Int. Cl.[2] ..... F23J 1/02

[52] U.S. Cl. ..... 110/171; 65/19

[58] Field of Search ..... 110/171, 165 R; 126/242, 243; 65/19

[56] References Cited

U.S. PATENT DOCUMENTS

| | | | |
|---|---|---|---|
| 3,412,698 | 11/1968 | Rivers | 110/171 X |
| 3,962,978 | 6/1976 | Bosman | 110/171 X |
| 4,018,588 | 4/1977 | Hardy, Jr. | 110/171 X |

*Primary Examiner*—Edward G. Favors

*Attorney, Agent, or Firm*—Robert L. Olson

[57] ABSTRACT

An ash removal system for a coal-fired boiler, where the temperature of the water in the ash hopper is maintained at approximately 140° F. under all operating conditions of the boiler, by running cooling water through heat exchange surface positioned in the ash hopper. The cooling water, after picking up heat, is passed through heat exchange surface located outside of the ash hopper, before being introduced into the ash hopper. Some of the heated cooling water can be used as low level heating fluid around the plant site, if desired.

3 Claims, 2 Drawing Figures

COOLING MEANS FOR A WATER-FILLED ASH HOPPER

BACKGROUND OF THE INVENTION

In coal-fired boilers, ash is generally removed from the furnace through a bottom opening therein. The ash falls into an ash hopper filled with water, from which the ash is intermittently removed. Water is constantly added to the ash hopper to replace water that evaporates and escapes up into the furnace, and also water removed from the hopper along with the ash. In addition, water is constantly added, and some removed, to keep the temperature of the water low enough so that the ash is thermally shocked when it hits the water. This causes large chunks of ash to disintegrate or splinter, when contacting the water, minimizing the formation of large clinkers, which is undesirable. In the past, there was little concern shown for the amount of water used, and a steady, high-flow rate of water was continuously passed into and out of the ash hopper to keep it at a low temperature. This high-flow rate was maintained under all operating conditions of the boiler. The water was usually taken from a lake or river, and the overflow from the ash hopper was discharged to a stagnant storage pond. Now that water pollution has become of vital concern, the above type of operation is highly undesirable.

SUMMARY OF THE INVENTION

In accordance with the invention, heat exchange surface is located within the ash hopper, preferably adjacent to and parallel to the inclined walls so as not to interfere with falling ash clinkers. Cooling water is passed through this surface, and then flows through a heat exchanger outside of the ash hopper to give up its heat prior to being discharged into the ash hopper. A temperature sensing means located in the ash hopper overflow pipe controls the amount of cooling water flowing to the heat exchanger in the ash hopper so as to maintain the water temperature in the ash hopper at 140 F.

DESCRIPTION OF THE PREFERRED EMBODIMENT

Figure 1:
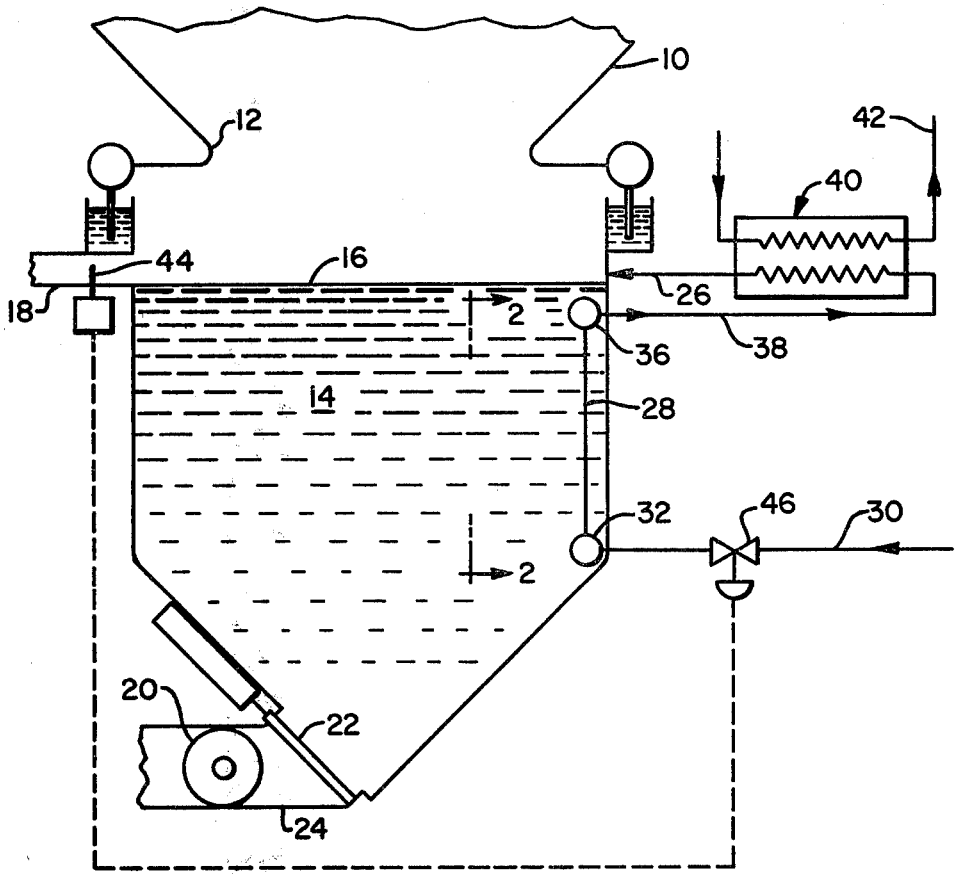
FIG. 1 is a schematic side view of an ash hopper for a coal-fired boiler constructed in accordance with the invention.

Looking now to FIG. 1, numeral 10 designates the furnace of a boiler in which coal is burned. Some of the lighter ash particles from the combustion of the coal are carried upwardly through the boiler with the hot combustion gases. The heavier ash particle (approximately 50% of the total) are gravity discharged from the furnace through bottom outlet 12. This ash falls into the ash hopper 14, which is filled with water to a level 16. An overflow pipe 18 maintains the water in the ash hopper at the level 16. The ash falling into the hopper 14 gravitates to the bottom, where any large clinkers are broken up by the clinker grinder 20 when they are discharged. Periodically, gate valve 22 in the outlet pipe 24 is opened so that the accumulated ash can be flushed from the ash hopper 14.

Figure 2:
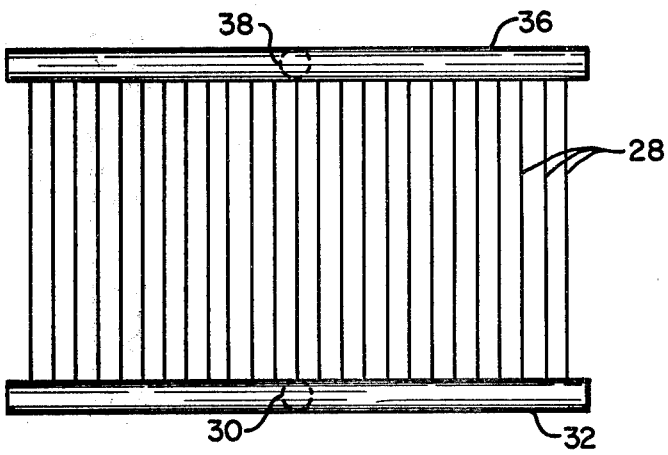
FIG. 2 is a view taken on line 2—2 of FIG. 1.

Water is introduced into the ash hopper 14 through pipe 26. This water originally flows into a heat exchanger 28 located in the ash hopper 14, from inlet pipe 30 and inlet header 32 (see FIGS. 1 and 2). After flowing through tubes 28, and absorbing heat from the water in the ash hopper, the heated water flows via outlet header 36 and pipe 38. It then flows to heat exchanger 40 where it gives up heat to a fluid 42. This fluid can be used for air preheating, as preheated feed water, or any other low level heating needs at a steam generator plant site. As can be seen, the heating surface 28 is positioned vertically, closely adjacent to and parallel to one of the walls of the ash hopper. Thus, as large ash particles fall into the ash hopper from the bottom of the furnace, they will not be damaged.

A temperature sensing device 44 is located in the outlet pipe 18. This controls valve 46 which is located in inlet pipe 30, to maintain the temperature within the ash hopper 14 at approximately 140 F. A number of factors can cause the temperature of the water within the ash hopper to tend to rise above 140 F. Some of these are: (1) increase in boiler load (and thus increasing coal burned); (2) increase in the percent ash contained in the coal; (3) increase in the temperature of the water entering in pipe 30 (from a lake or river as seasons change). It is desirable to maintain the water in the ash hopper 14 at 140 F. or below so that there is sufficient thermal shock of the ashes to cause them to splinter or disintegrate when they hit the water. Larger clinkers can jam the clinker grinder 20, causing shut-down of the operation.

What is claimed is:

1. In combination, a furnace in which coal is burned, outlet means in the bottom of the furnace through which ash is discharged, an ash hopper located beneath the outlet means, water inlet means for introducing water into the ash hopper, an overflow pipe connected to the ash hopper a predetermined height above the bottom of the ash hopper through which water is discharged therefrom, so as to maintain a predetermined level of water therein, temperature sensing means for detecting the temperature of the water in the ash hopper, control means in the water inlet means responsive to the temperature sensing means such that a predetermined temperature of the water in the ash hopper is maintained, first heat exchange means positioned in the ash hopper, second heat exchange means located outside of the ash hopper, the water inlet means being connected to the two heat exchange means such that the water first passes through the first heat exchange means to absorb heat from the ash hopper, and then gives up heat in passing through the second heat exchange means, prior to its discharge into the ash hopper.

2. The combination as set forth in claim 1, wherein the first heat exchange means is parallel to and closely adjacent to one of the side walls of the ash hopper.

3. The combination as set forth in claim 2 wherein the control means maintains a temperature of approximately 140° F. of the water in the ash hopper.

* * * * *